US005357107A

United States Patent [19]

Ibach et al.

[11] Patent Number: 5,357,107

[45] Date of Patent: Oct. 18, 1994

[54] ELECTROSTATIC DEFLECTOR WITH GENERALLY CYLINDRICAL CONFIGURATION

[75] Inventors: Harald Ibach, Aachen; Dieter Bruchmann, Aldenhoven; Sieghart Lehwald, Jülich, all of Fed. Rep. of Germany

[73] Assignee: Forschungszentrum Julich GmbH, Julich, Fed. Rep. of Germany

[21] Appl. No.: 12,537

[22] Filed: Feb. 2, 1993

[30] Foreign Application Priority Data

Feb. 3, 1992 [DE] Fed. Rep. of Germany ..... 4202985
Nov. 27, 1992 [DE] Fed. Rep. of Germany ..... 4239866

[51] Int. Cl.[5] ..... H01J 40/00; H01J 47/00
[52] U.S. Cl. ..... 250/305
[58] Field of Search ..... 250/305

[56] References Cited

U.S. PATENT DOCUMENTS 3,710,103 1/1973 Helmer ..... 250/305
4,959,544 9/1990 Sukenobu ..... 250/305

FOREIGN PATENT DOCUMENTS 2620877 7/1982 Fed. Rep. of Germany .
2848538 10/1986 Fed. Rep. of Germany .
0194446 11/1982 Japan ..... 250/305
61-161645 7/1986 Japan .

OTHER PUBLICATIONS

K. Jost; "Fringing Field Correction for 127° and 180° Electron Spectrometers"; Sci. Instrum., vol. 12, 1979; pp. 1001-1005.
H. A. Van Hoof; "An Electrostatic Lens for Polar-Angle Selection of Photoemitted Electrons"; Sci. Instrum., vol. 14, 1981; pp. 325-329.
I. Takeshita; "Mattach-Herzog Type Mass Spectrograph with Corrected-Dependent Image Defects . . . "; vol. 38, No. 10, Oct. 1987; pp. 1361-1367.
Y. Gao et al; "A Design Innovation for the 127° Differential Electron Energy Analyser"; Sci. Instrum., vol. 18, 1985; pp. 381-383.
Soviet Physics Technical Physics, Bd. 35 Nr. 2 Feb. 1990.
Nuclear Instruments & Methods in Physics Bd 292 15 Jul. 1990.
H. Liebl Stigmatic Sector-Field Energy p. 540.
Optics of Charged Particles Hermann Wollnik 1987.
Springer Series in Optical Sciences vol. 63 Peter W. Hawkes.
Novel design of a sperical electron spectrometer K. Jost 1979.
Stigmatic Sector-Field Energy Analyzer Without Second-Order Angular Image Aberrations, Helmut Liebel, pp. 537-540 (1990).
Cylindrical Capacitor as an Analyzer I. Nonrelativistic Part, H. Z. Sar-El, vol. 38, No. 9, pp. 1210-1216.
Ion Microprobe Mass Analyzer, Helmut Liebel, pp. 5277-5283, vol. 38, No. 13.

*Primary Examiner*—Bruce C. Anderson
*Attorney, Agent, or Firm*—Herbert Dubno

[57] ABSTRACT

An electrostatic deflector for energy selection of a beam of charged particles has a plurality of main deflector plates arrayed in a generally cylindrical basic shape and to which electrostatic potentials are applied. The main deflector plates are shaped and the potentials are applied to generate a path of said beam from an input side of said deflector to an output side thereof by virtue of a deflecting field which is increasingly weakened to both sides of a central portion of the beam toward the main deflector plates relative to a field of ideal cylindrical shape, thereby causing second order angular aberration of the beam to substantially vanish. A pair of end deflector plates at opposite ends of the cylindrical basic shape have a repulsive potential with respect to the beam to effect focussing of the beam perpendicular to a dispersion plane of the deflector.

17 Claims, 7 Drawing Sheets

ELECTROSTATIC DEFLECTOR WITH GENERALLY CYLINDRICAL CONFIGURATION

FIELD OF INVENTION

The invention relates to an electrostatic deflector with a generally cylindrical basis configuration for the energy selection of charged particles, between the correspondingly shaped deflecting plates of which, on both sides of the central beam, a deflecting field prevails which, by contrast with the field of an ideal cylindrical basic configuration, weakens increasingly towards the plates so that at least the second order angular aberration in the dispersion plane vanishes.

BACKGROUND OF THE INVENTION

The energy selection of charged particles, e.g. electrons, is effected preferably by electrostatic deflection systems. Their effects depend upon the different degrees of deflection of particles with different energies which enables the discrimination against particles of undesired energies. Advantageous electrostatic energy filters which have been provided heretofore are predominantly the cylindrical mirror, the spherical deflector and the cylindrical deflector which have found widespread use in practice, although basically planar deflecting plates can be used as well. Theoretically the toroidal deflector has also been investigated (Hermann Wollnik, Optics of Charge Particles, p. 119, Academic Press, Orlando, 1987).

All of these mentioned energy filters are characterized by appropriate dimensioning to provide at least first order angular focussing in the energy dispersion plane. Depending upon the geometry of the filter chosen, these dispersion planes form a family of planes which are parallel to one another as in the cylindrical deflector, or are inclined to one another, as in the toroidal and spherical deflectors or in the cylindrical mirror. The spherical deflector and the cylindrical mirror also have the especially advantageous stigmatic focussing.

The angular focussing enables a focussed transport of charged particles with a solid angle different from zero through the energy filter. The magnitude of the admissible solid angle is, however, limited by image aberrations, especially angular aberrations. As a result, the energy filtering is poorer for particles arriving out of a larger solid angle. The admissible solid angle for the arriving particles must therefore be restricted by apertures. In an analogy to light optics, one has a limitation of the luminosity due to the image aberrations. For cylindrical, toroidal and spherical deflectors, the smallest nonvanishing angular aberration in the dispersion plane is of the second order in the angle, whereas for the cylindrical mirror of suitable construction, the first nonvanishing angular aberration is of third order.

Thus, with reference to the angular aberrations, the cylindrical mirror is more advantageous than the deflectors. On the other hand, deflectors enable the use of input and output slits with the energy filtering being, to a first approximation, independent of the slit height. With a cylindrical mirror, radially symmetrical hole apertures must be used as input and output apertures. Depending upon the application, therefore, either the cylindrical mirror or the deflectors can have advantages and will be preferred.

For the so-called electrostatic toroidal condenser of generally cylindrical basic configuration, a correction of the second order angular aberration in the dispersion plane has already been provided (DE-PS 26 20 877) by appropriate opposing curvatures of the deflection plates perpendicular to the dispersion plane. In this arrangement, an axial curvature of the potential characteristic in the region of the central beam is excluded ($R_e = \infty$). This means that the described deflector has no focussing effect perpendicular to the dispersion plane for a radiation bundle around the central beam. The drawback of this concept thus resides in a limitation of the usable solid angle; especially, this system has the disadvantage of nonstigmatic focussing, as in conventional toroidal deflectors or cylindrical deflectors.

Up to now, moreover, it has not been possible to determine the influence of the fringe field distortion from the input and output apertures upon the elimination of the second order angular aberration, since the calculations are of an analytical nature and are based upon an ideal toroidal field.

An effort to transfer the described possibility of eliminating the angular aberration to the spherical deflector leads to a loss of the stigmatic focussing of this system, since the stigmatic focussing of the spherical deflector results from the spherical symmetry thereof and the transfer of the described configuration to the spherical deflector results in a deviation from the spherical symmetry.

OBJECTS OF THE INVENTION

It is the principal object of the present invention to provide an improved deflector for charged particles which can be used as an energy analyzer or monochromator and which avoids drawbacks of prior art.

Still another object of this invention is to provide a deflector capable of the stigmatic focussing of a particle beam.

It is also an object of this invention to provide a deflector for a beam of charged particles which is practically free from angular aberration of the second order or higher in at least one dispersion plane.

An object of the invention, therefore, is to provide an electrostatic deflector with an energy-filtering effect and high useful solid angle and preferably stigmatic focussing with a vanishing angular aberration of at least second order in at least one dispersion plane.

SUMMARY OF THE INVENTION

These objects are achieved according to the invention with an electrostatic deflector of the type described and with generally cylindrical configuration, the deflecting field of which weakens increasingly towards the plates and which is characterized by additional end-deflecting plates at a repulsive potential for a focussing effect perpendicular to the dispersion plane.

The deflection field which progressively weakens in the dispersion plane on both sides of the central beam can be achieved by a bi-convex curvature or bulging of the generally cylindrical deflection plates (which are referred to below as main deflector plates) in the rz-direction or by a subdivision (perpendicular to the cylinder axis) thereof into at least 3 segments which can be brought to different potentials to yield a corresponding characteristic pattern of the deflection field. If desired, bulging of the plates and subdivision thereof into segments can be combined for a cumulative effect.

In the following text, the two main deflection plates, even when subdivided into a plurality of plate pieces, will be simply referred to as two main deflection plates.

The end-side deflection plates preferably should enable a stigmatic focussing of the charged particles by penetration of the field towards the central beam.

This can be achieved by a mean radial spacing between the main deflection plates which is at least equal to half the distance between the end-side deflection plates and is so dimensioned that upon application of a potential of suitable strength to the end-side deflection plates, an approximately spherical curvature of the equipotential surfaces around the central beam will result.

According to the invention, the curvature of the equipotential surfaces within the deflector is basically achieved with the use of the four deflection plates by an at least partial spatial enclosure with sufficient field penetration towards the region of the central beam. Hence the geometrically simple configuration of the deflection plates is so altered that, while retaining the elimination of the angular aberration in the dispersion plane, a focussing perpendicular to the dispersion plane or a stigmatic focussing is achieved. The shape of the end-deflection plates can be chosen to suit the function. Especially suitable is a planar and parallel arrangement of these deflection plates.

The resulting deflector, which is described in terms of a generally cylindrical basic configuration to facilitate understanding, forms a deflector of the four-plate type which does not correspond to conventional spherical, cylindrical or toroidal deflector shapes.

An optimum operation in terms of focussing and intensity will depend upon an appropriate choice of the following controlling parameters for the desired purpose:

ratio of the radial spacing of the main deflector plates to the spacing of the end-side deflector plates;

shape of the bulge of the main deflector plates and/or the plate subdivision and the potential distribution thereof;

spacing of the main deflector plates relative to the plate radius; and size of the gaps between the main deflector plates and the end-side deflector plates.

Such optimization can be obtained by a corresponding calculation of the field pattern with variation and matching of the controlling parameters via a suitable computer program, using as an additional variable the deflection angle $\theta$ which generally lies in the range of 100° to 150°. This angle $\theta$ is varied during the optimization such that the desired focussing in the radial plane at the output of the deflector is achieved.

It has previously been discussed by K. Jost (J. Phys. E: Sci. Instr. 12 (1979), pages 1006 ff.) that a stigmatic focussing could be achieved even with the use of non-spherical deflecting plates when these are used in conjunction with a pair of end-deflection plates parallel to the dispersion plane of the central beam. By the application of a negative potential with reference to $E_o$ (or a positive potential) to this additional pair of electrodes, the focussing perpendicular to the dispersion plane could be enhanced or (weakended) with a simultaneous weakening or (reinforcement) of the focussing in the dispersion plane, so that for a given deflection angle stigmatic focussing could be achieved. A corresponding particle energy analyzer of this type with main deflection plates having an approximately spherical shape was disclosed by Jost. The effect of these additional deflection plates has been systematically investigated by H. Ibach by numerical methods (H. Ibach: "Electron Energy Loss Spectrometers", Springer Series in Optical Sciences, Vol. 63, page 36, Spinger-Verlag, 1991) and it has been shown that stigmatic focussing can be achieved even with cylindrical main deflector plates. These systematic studies, however, do not disclose any elimination of the second order angular aberration in the dispersion plane.

Only with the combination, according to the invention, of bulging or subdivided generally cylindrical main deflector plates (with the distributed potential applicable to the segments of the subdivided plates as described) with sufficient penetration of the repulsive potential from the end-side deflecting plates is it possible to achieve both, a correction of the angular aberration and a focussing perpendicular to the dispersion plane and thus a substantial increase in the admissible solid angle and, therefore, in the terminology used for optical systems, a higher luminosity.

Since the quadratic angular aberration has a negative sign, rays with larger angles are excessively deflected in the radial direction and this effect can be eliminated by the progressive weakening of the field in the dispersion plane on both sides of the central beam. This weakening can be achieved by analogy to the system of DE-PS 26 20 877 by the use of bulges in the main deflecting plates perpendicular to the dispersion plane of the central beam. The required form and extent of this bulging which can yield an elimination of the second order angular aberration can be obtained by numerical simulation of the particle trajectories by conventional techniques. This is especially the case when fringe field effects from metallic input and output apertures are present. In an analogous manner the appropriate potentials for the subdivided main deflection plates can be determined.

The shapes of the bulge of the "inner" as well as of the "outer" main deflector plates are, in principle, independent of one another, as is their approach to the end faces. In an especially simple arrangement, these plates are symmetrically shaped towards all sides.

For the shape and potential distribution of the main deflection plates consisting cylindrical sectors, the following considerations apply:

The ideal cylindrical field is the field between two concentric metallic cylinders of unlimited length along the cylinder axis. If one considers a charged particle having the charge e which moves on a circular trajectory the cylinders perpendicular to the axis of the cylinder (hereinafter referred to as the z-axis), its energy $E_o$ is given by $$E_o = \frac{e\Delta V}{\ln(R_2/R_1)} \tag{1}$$

In this relation, $\Delta V$ is the voltage difference between the cylinders and $R_2$ and $R_1$ are the radii of the outer and inner cylinders, respectively. Particles, which intersect the circular trajectory of radius $r_o$ at a particular point within the circular plane (hereinafter the r,$\theta$ plane) with a small angle $\alpha$, intersect this circular trajectory a second time after a deflection angle of $$\theta_f = \pi/\sqrt{2} \approx 127.3^\circ .$$

This angle refers to the ideal cylindrical field only. For modified deflection fields of basically cylindrical form the focussing angle may vary between 100°–150°.

If apertures are provided at the two intersection points, energy selection is achieved for particles in a given range of angles $\alpha$. If the deviation from the radius $r_o$ at the input aperture is denoted as $y_1$ and the deviation at the output aperture is denoted as $y_2$, the imaging equation is given by $$y_2 = -y_1 + r_o \frac{\delta E}{E_o} - \frac{4}{3} r_o \alpha^2 \quad (2)$$

in which $\delta E$ is the deviation from the energy $E_o$. For small angles $\alpha$, therefore, particles with $\delta E=0$ are imaged perfectly upon the output aperture with the size of the image of the input aperture being equal to the size of the input aperture itself.

Advantageously, the input and output apertures are formed as slits and the width s of the two slits are equal. The slits are elongated parallel to the cylinder axis. As long as the slits are not too long (H. Ibach, op. cit. pp. 27 ff.) their length is of minor significance for the energy resolution.

As can easily be seen from equation (2), the base width $\Delta E_B$ of the transmitted energy distribution is given by (H. Ibach, op. cit. pp. 17 ff.):

$$\frac{\Delta E_B}{E_o} = \frac{2s}{r_o} + \frac{4}{3} \alpha_m^2 \quad (3)$$

with $\alpha_m$ as the maximum angle $\alpha$. Preferably this angle $\alpha_m$ is limited to the value beyond which particles of the energy $E_o$ are no longer passed. From equation (2), this means $$\alpha_m = \sqrt{\frac{3s}{4r_o}} \quad (4)$$

The input and output slits of the cylindrical deflector are preferably formed from metallic materials which necessarily form equipotential surfaces. As a result the deflection angle which is required to achieve angular focussing of the first order, is reduced.

The aforedescribed focussing characteristics do not actually require real input and/or output apertures; the explained conditions, rather, also apply when the deflector, e.g. as a component of a multideflector or energy analysis system, is provided in an assembly for focussing charged particles without special apertures.

The shape of the deflection plates suitable to provide the appropriate outwardly bulging equipotential surfaces for the family of near central trajectories, can also be approximated by three segments (parts) perpendicular to the z-axis, with different radii of curvature. In this case, the inner cylindrical deflecting plate has a radius of curvature in the r,$\theta$-plane which increases towards the top and bottom ends of the cylinder along the direction of the cylinder axis, and for the outer deflecting plate the radius of curvature decreases towards the top and bottom ends.

An especially simple construction has individual segments each of constant radius of curvature. The described curvature of the equipotential surfaces in the rz-plane permits the use of cylindrical deflection plates of a conventional construction, however subdivided along the z-axis into at least three segments to which different potentials are applied.

Finally, in generalization a free configuration of the deflection plates is possible, whereby starting with a simple geometric basic shape, the optimum shape can be determined by numerical analytical calculation of particle trajectories by using conventional techniques. One possibility of developing such an optimum shape utilizes a subdivision of the selected basic shape into numerous sections or segments with various voltages applied to these sections. The potential distribution is then calculated such as to achieve a corrected focussing so that the plate sections will generate a family of equipotential surfaces with increasing weakening of the deflection field toward the deflection plates. Metallic plates can then be shaped such as to correspond to two optional outer equipotential surfaces of this family of equipotential surfaces, and the plates thus shaped are supplied with a voltage difference depending upon the particle type and energy so that the desired imaging behavior will result according to the invention.

The aforementioned boundary weakening of the deflection field in the dispersion plane can also be augmented by bulging the cylinder surfaces in the dispersion plane. Thus parallel to the dispersion plane the cylinder surfaces may consist of segments (parts) whose radii of curvature differ from one another (FIG. 9*b*).

In general, it is preferred to provide a mirror-symmetrical contour of the deflection plates with respect to the symmetry plane corresponding to the mean dispersion plane.

In combination with the aforedescribed features of the invention, we can also make advantageous use of curved input and/or output apertures as well as of curved input and/or output slits.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
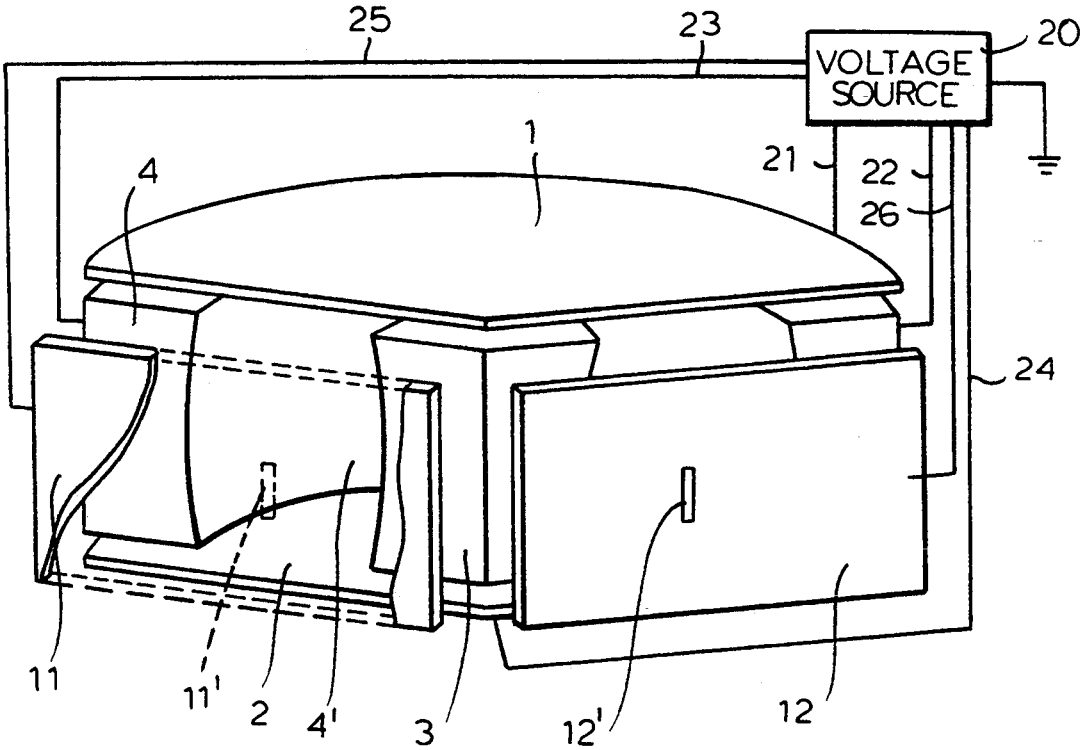
FIG. 1 is a perspective view, partly broken away, of a deflector according to the invention, provided with four deflection plates and input and output apertures, e.g. for use in a particle energy analyzer.
Figure 2:
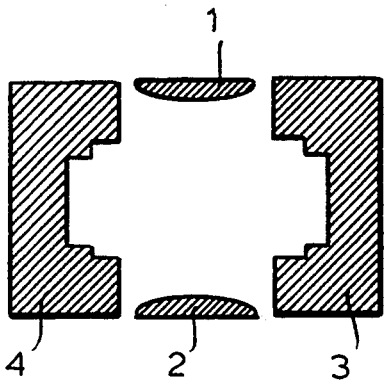
FIG. 2 is a cross section view illustrating an embodiment having an alternative configuration than that of FIG. 1 for the main deflector plates.

A deflector according to the invention comprises a pair of end-side deflector plates (cover plates) 1 and 2 to which an appropriate voltage is applied in combination with the further main deflector plates 3 and 4 or 5–10 to achieve a stigmatic focussing of the slit 11' of the aperture 11 upon the slit 12' of the aperture 12. The deflector is used in the conventional manner as an energy analyzer for a particle beam entering the input slit 11' and excludes particles having an energy different from the pass energy.

Particles with the pass energy, of course, are deflected and emerge through the slit 12'. The particle beam source and the target for the selected energy beam have not been shown. However, in diagrammatic form, we have illustrated at 20 a voltage source which is connected by leads 21, 22, 23, 24, 25, and 26 to the deflector plates 1–4 and the input and output aperture 11 and 12. The same type of voltage source can be connected to various segments of these plates when especially the main plates 3, 4 are subdivided into segments (as shown in FIG. 4) to which different potentials are applied.

In order to generate a sufficient field penetration and stigmatic focussing with moderate potentials applied to the cover plates 1, 2, the spacing between the deflector plates 3 and 4 or 5–7 and 8–10 is preferably not smaller than one-half the distance between the plates 1 and 2.

Figure 4:
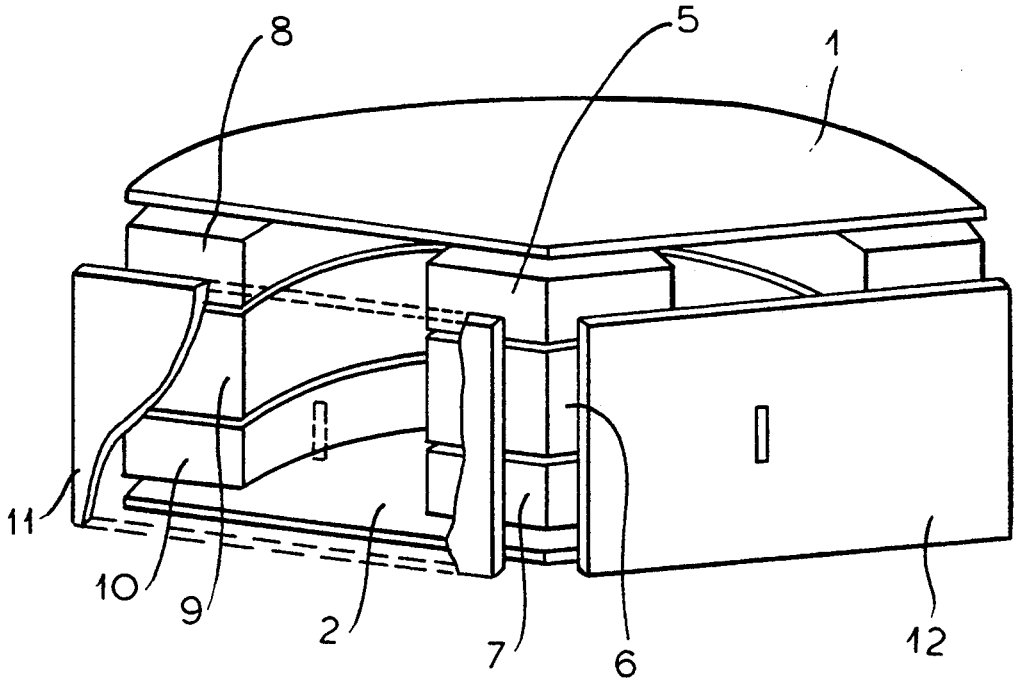
FIG. 4 is a perspective view similar to FIG. 1 but showing a deflector with subdivided main deflector plates according to the invention.

The deflection angle in the dispersion plane in the embodiment of FIGS. 1 and 4 is 145°. The optimum value for the deflection angle depends upon the ratio of the radii of the deflecting plates 3 and 4 or 5–7 and 8–10 and upon the spacing between the cover plates 1 and 2 and must be determined by numerical simulation.

For the elimination of the angular aberration in at least second order, the deflecting field is, according to the invention, weakened to both sides of the central beam by the opposing curvatures of the deflecting plates 3 and 4 perpendicular to the dispersion planes. This curvature can be readily seen in FIG. 1 for the inwardly facing surface 4' of the plate 4.

The radii of this curvature are also determined by numerical simulation.

A comparable effect can be achieved by subdividing the deflecting plates each into three segments 5, 6, 7 and 8, 9, 10 (FIG. 4). The segments are brought to different potentials from a source analogous to the source 20 and such that the potential distribution within the space between the deflecting plates is substantially the same as that of FIG. 1. In practice, the potentials at segments 8 and 10 are more negative than the potential on segment 9 and the potential on segments 5 and 7 are less positive than the potential on segment 6. Of course, it would be possible to combine a subdivided main deflector plate with an undivided but curved counter plate.

Subdividing the main deflecting plates has the advantage of greater flexibility in establishing optimum focussing conditions and in eliminating the angular distortion. It has, however, the drawback of greater complexity of the required voltage supply.

For a deflector according to FIG. 1, the particle trajectories, e.g. electron trajectories are determined by numerical simulation. In the upper diagram of FIG. 5*a* which represents a section in the central dispersion plane showing the electron trajectories, the electrons are assumed to enter the deflector at angles $\alpha = -10$, $-5$, 0, $+5$ and $+10$ degrees.

In the central diagram 5*b*, the projection of the particle trajectories perpendicular to the dispersion plane are shown for the insertion angle $\beta = -2$, $-1$, 0, $+1$ and $+2$ degrees. Apparent from these diagrams is a focussing with respect to the angle $\alpha$ in the dispersion plane and with respect to the angle $\beta$ perpendicular to the dispersion plane, i.e. a stigmatic imaging of the input plane onto the output plane.

The lower diagram 5*c* plot the entrance angle versus the output position, i.e. the output position as a function of the input angle $\alpha$ in the dispersion plane. The imaging demonstrates a substantially angular-aberration-free imaging.

Figure 5A:
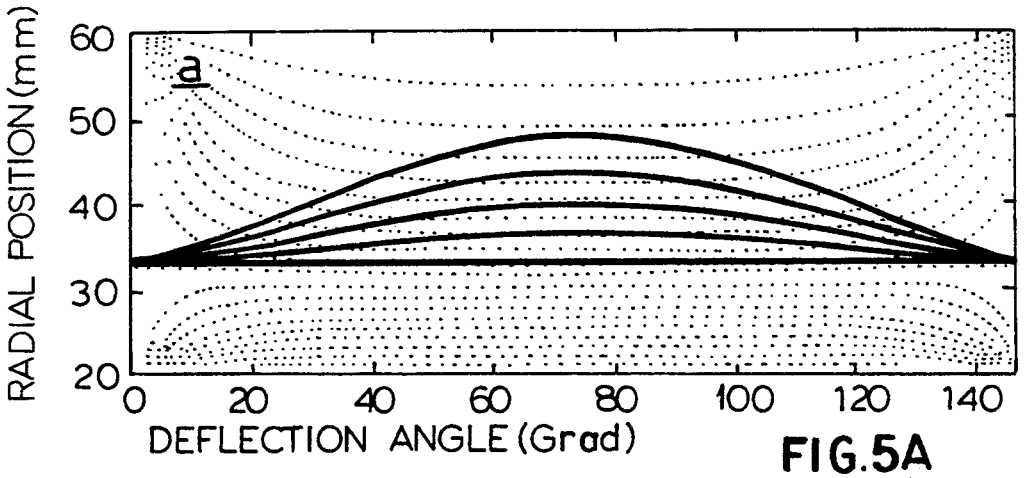
FIGS. 5A, 5B and 5C are a set of graphs illustrating the results of a numerical simulation of particle trajectories in a deflector of the type shown in FIG. 1.
Figure 5B:
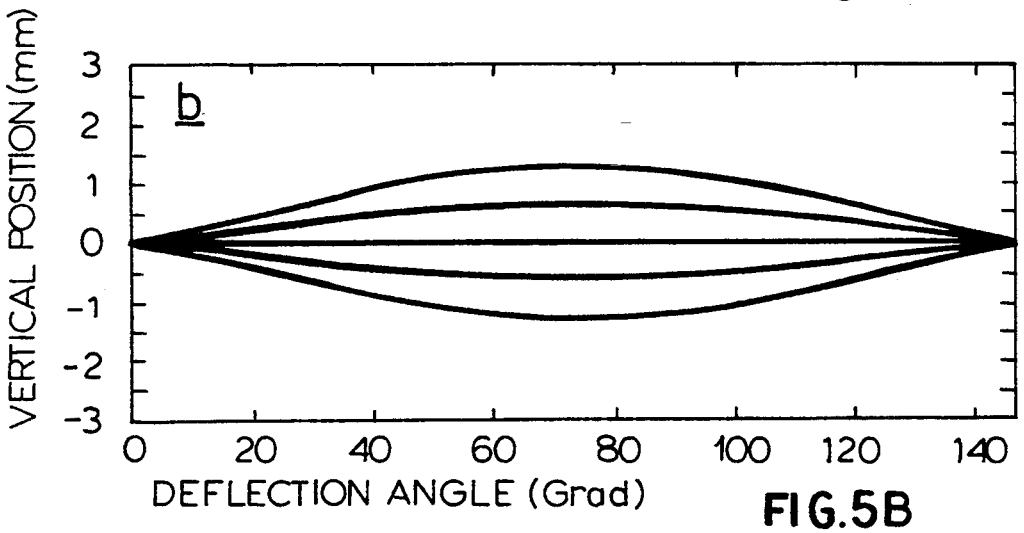
Figure 5C:
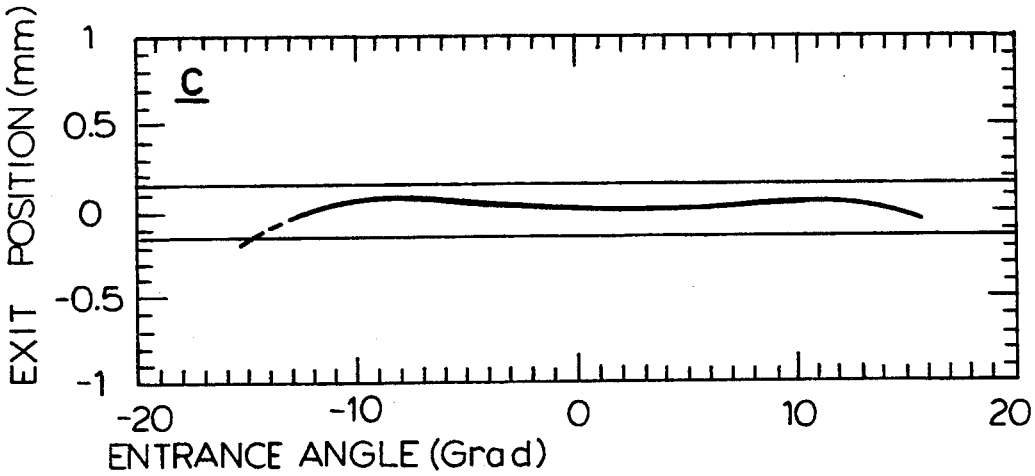
Figure 6:
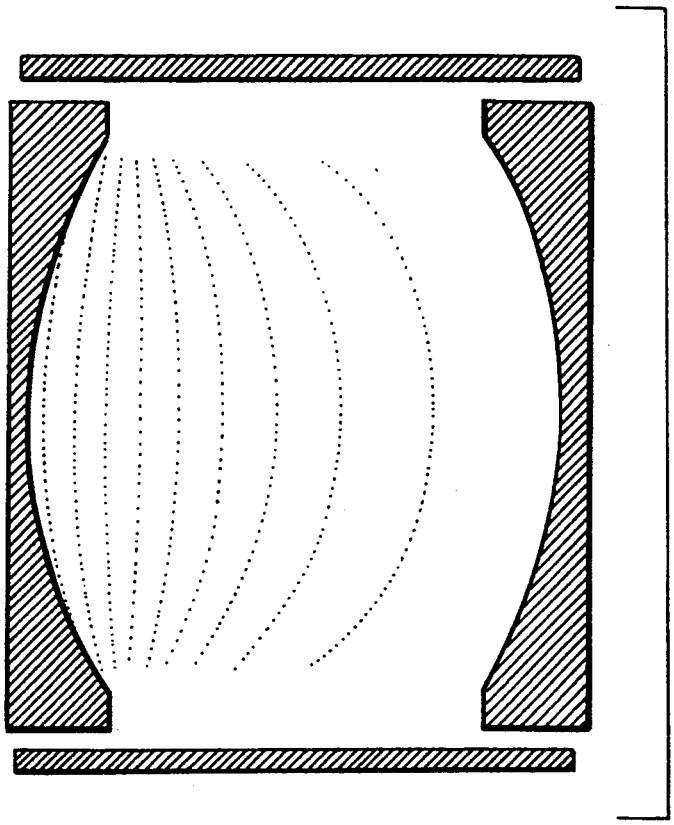
FIG. 6 is a cross sectional view through the deflector plates of the deflector of FIG. 1 with equipotential surfaces represented in dotted lines.

The shapes of the equipotential surfaces providing the results diagrammed in FIGS. 5A, 5B and 5C have been shown in FIG. 6 in a section perpendicular to the dispersion plane. It will be apparent that the same imaging characteristics can be achieved with an arrangement of only two deflection plates which are so shaped that a corresponding set of equipotential surfaces will result.

Figure 7A:
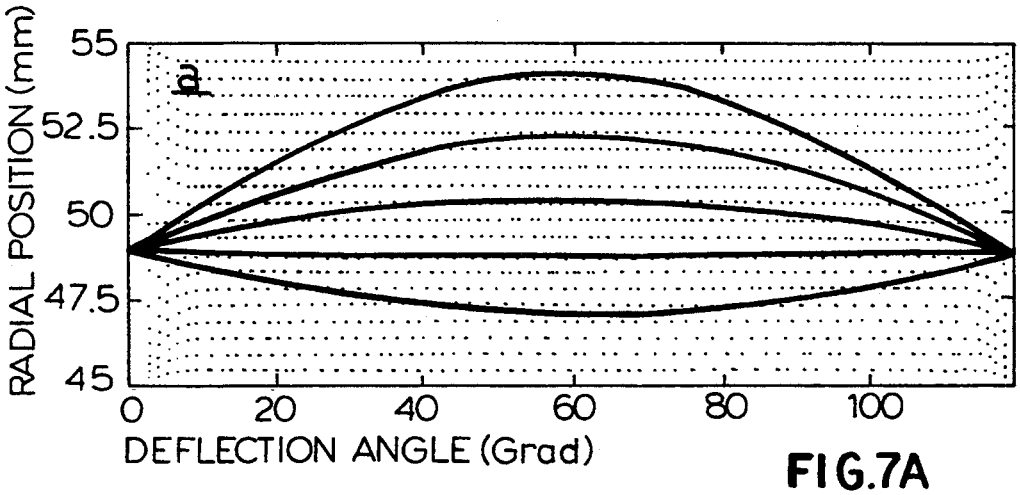
FIGS. 7A, 7B and 7C are a set of graphs representing a numerical simulations of the particle trajectories for a generator having curved main deflector plates according to DE-PS 26 20 877 but without the end deflector plates.
Figure 7B:
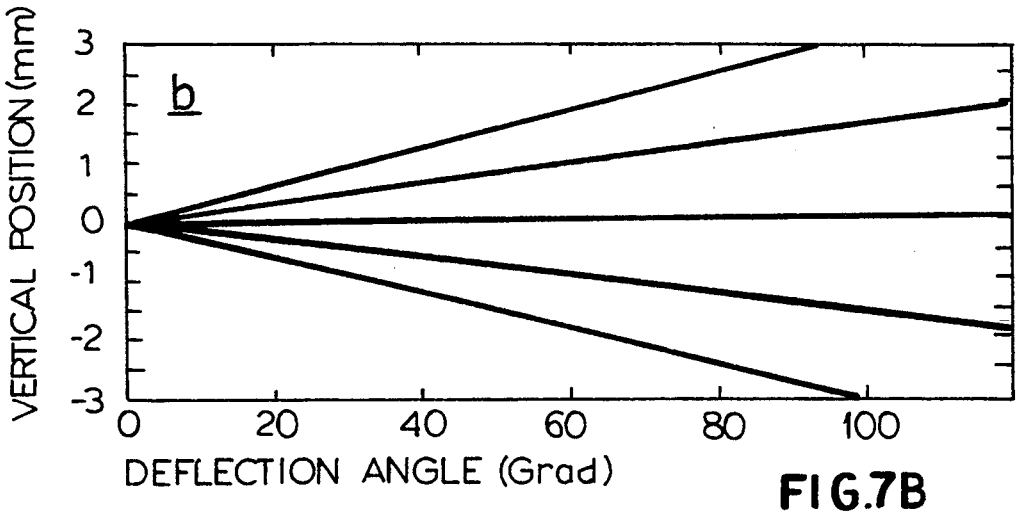
Figure 7C:
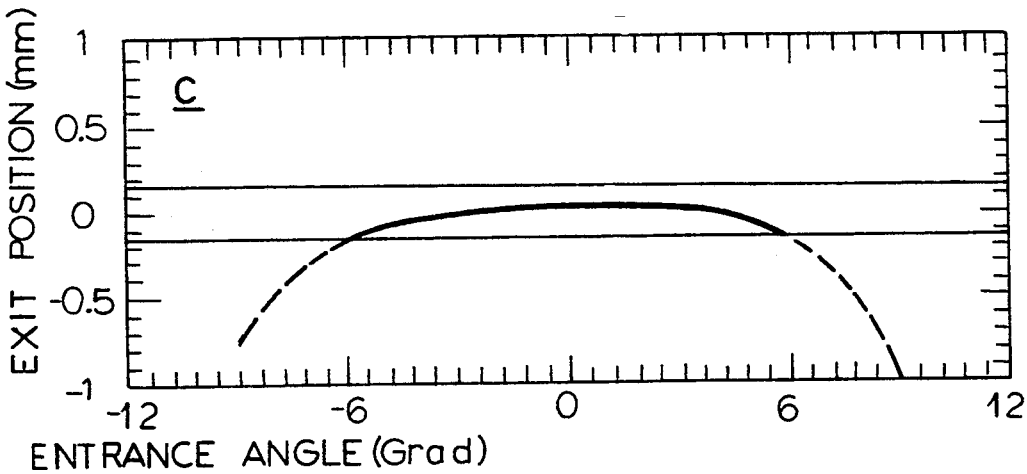

FIGS. 7A, 7B and 7C illustrate the results obtained with a numerical simulation of a deflector according to German patent document DE-PS 26 20 877, without end cover plates.

As in the upper diagram FIG. 5A, the upper diagram FIG. 7A, which is provided for comparison purposes only, is a section in the central dispersion plane and shows electron trajectories entering the deflector with angles $\alpha$ of $-6$, $-3$, 0, $+3$ and $+6$ degrees.

The diagram FIG. 7B shows projections of the electron trajectories perpendicular to the dispersion plane for injection angles $\beta$ of $-2$, $-1$, 0, $+1$ and $+2$ degrees.

In diagram FIG. 7C, the output position is plotted as a function of the input angle $\alpha$ in the dispersion plane.

It will be immediately apparent that the angle aberration elimination with this system is not nearly as complete as with the embodiment of FIG. 1. Also the analytical condition of aberration-free imaging of DE-PS 26 20 877 requires the ratio of the radii of the deflection plates to lie closer to 1 than with the embodiment of this invention. As a result, larger angles $\alpha$ cannot be used in an embodiment according to DE-PS 26 20 877 without causing the contact of the electrons with the deflection plates. As FIG. 7B shows, the deflector of the German patent document has no focussing effect perpendicular to the dispersion plane.

Figure 3:
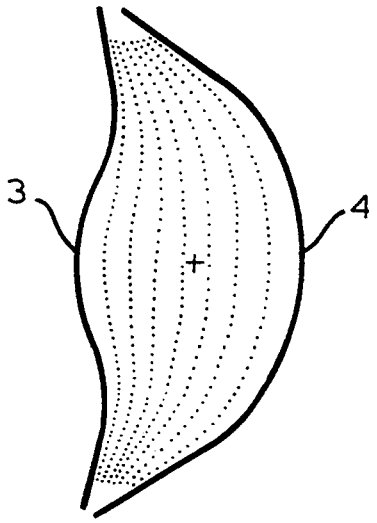
FIG. 3 is a diagram, effectively in cross section, showing the equipotential surfaces and the envelope curve generated by two main deflection plates in an approximation to the four plate-type deflector of FIG. 1.
Figure 8B:
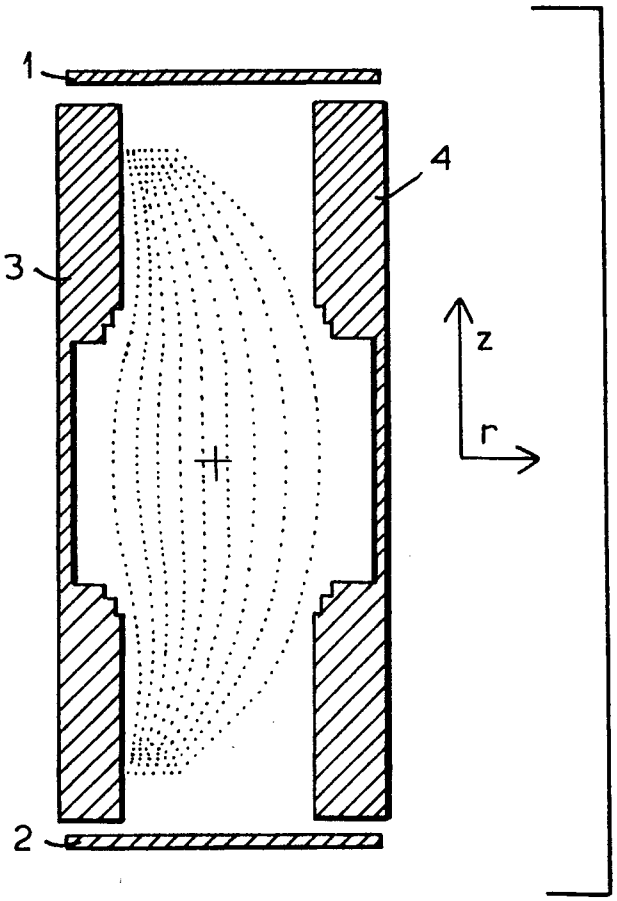
FIG. 8*a* and FIG. 8*b* are cross sectional views showing the variations in the equipotential planes effected by different potentials on the deflector plates in an embodiment of the type shown in FIG. 2.
Figure 8A:
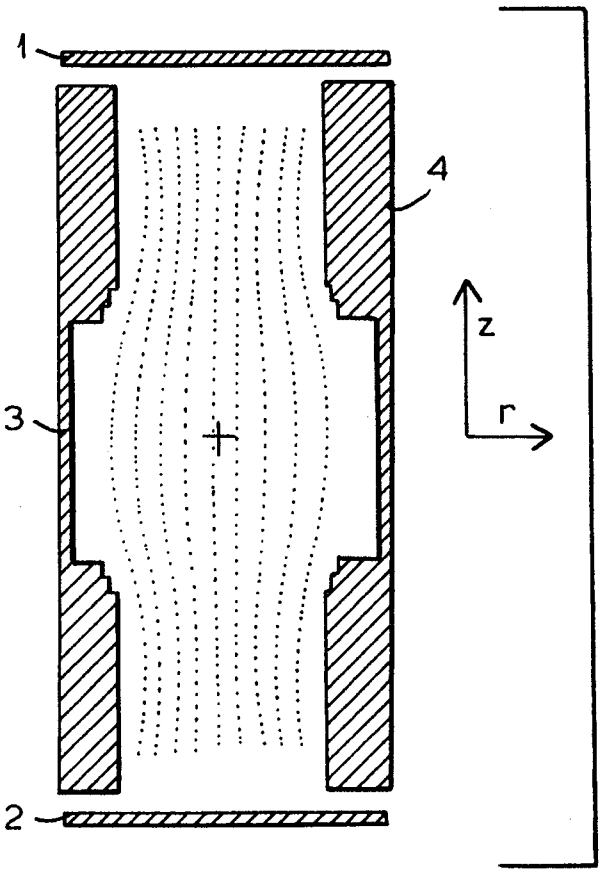

The arrangement of FIGS. 8*a* and 8*b* is symmetrical with respect to the central dispersion plane and radii of the individual segments are constant for the respective segments. The cross marks the center of the particle paths. The cover plates 1 and 2 are brought to potentials corresponding to the arithmetic mean of the potentials applied to the deflector plates 3, 4 in the configuration of FIG. 8*a* and to a negative potential in the configuration of FIG. 8*b*. The dotted lines show the equipotential surfaces. FIG. 3 represents the equipotential surfaces generated by two plates having the configuration of the equipotential surfaces of FIG. 8*b*. In this case, the deflecting plates have a constant curvature in planes perpendicular to the plane of the drawing and the equipotential surfaces are shown by dotted lines while the cross shows the center of the particle paths.

Figure 9A:
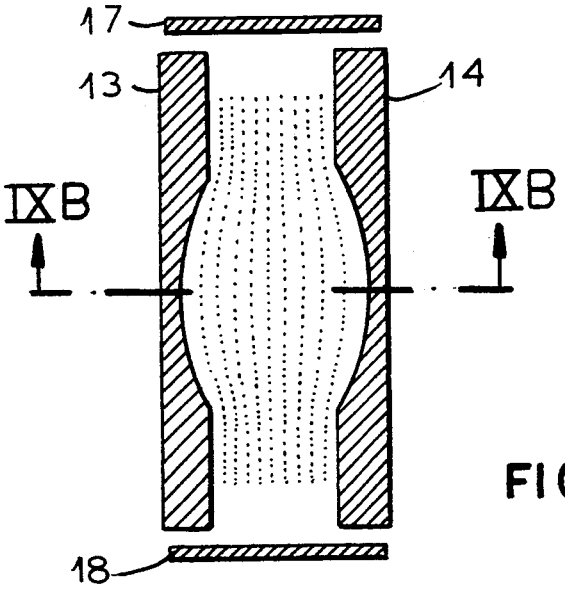
FIG. 9*a* is a cross sectional view similar to FIG. 8*a* for a deflector having an additional outward bulge in the dispersion plane.
Figure 9B:
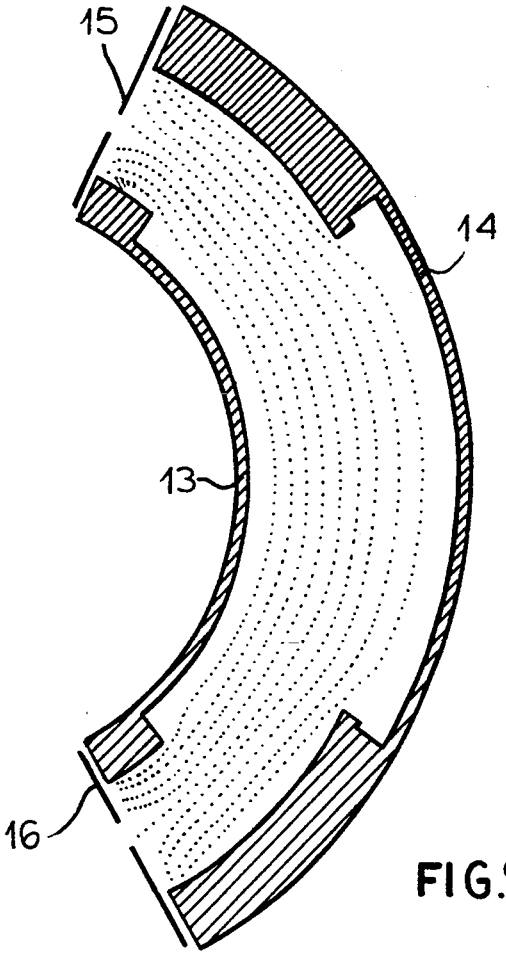
FIG. 9*b* is a cross sectional view taken along the line IXb—IXb of FIG. 9*a*.

FIG. 9*a* and 9*b* illustrate another family of equipotential surfaces shown in dotted lines between diaphragms 15 and 16, two main deflector plates 13 and 14 and the end cover plates 17 and 18, the main deflector plates additionally, showing bulging within the dispersion plane.

We claim:

1. An electrostatic deflector for energy selection of a beam of charged particles, comprising:

a plurality of main deflector plates forming cylinder sectors around a cylinder axis to which electrostatic potentials are applied resulting in dispersion planes perpendicular to the cylinder axis, said main deflector plates being shaped and said potentials being applied to generate a path of said beam from an input side of said deflector to an output side thereof transverse to said axis by virtue of a deflecting field which is increasingly weakened to both sides of a central portion of the beam toward the main deflector plates relative to a field of ideal cylindrical shape, thereby causing the second order angular abberation of the beam within the dispersion plane to substantially vanish; and a pair of end deflector plates at opposite ends of the main deflector plates and having a repulsive potential with respect to said beam to effect focussing of said beam perpendicular to a dispersion plane of the deflector.

2. The electrostatic deflector defined in claim 1 wherein said main deflector plates have a generally biconvex outwardly bulging curvature in an rz-plane whereby r represents a radial direction and z represents a direction along an axis of the cylindrical basic shape.

3. The electrostatic deflector defined in claim 2 wherein said main deflector plates have a mean spacing at least equal to half a distance between said end deflector plates and so dimensioned that upon application of potential to said end deflector plates, equipotential surfaces are formed between said plates with an approximately spherical curvature around said central portion of said beam.

4. The electrostatic deflector defined in claim 3 wherein said end deflector plates are generally planar.

5. The electrostatic deflector defined in claim 3 wherein said end plates are mutually parallel.

6. The electrostatic deflector defined in claim 2 wherein said main deflector plates have cylinder radii which vary in a direction of the axis in segments.

7. The electrostatic deflector defined in claim 6 wherein the radius of each of said plate segments is constant.

8. The electrostatic deflector defined in claim 1 wherein each of said main deflector plates is subdivided into at least three segments perpendicular to the axis and different potentials are applied to the segments of each of said main deflector plates.

9. The electrostatic deflector defined in claim 8 wherein said main deflector plates have a mean spacing at least equal to half a distance between said end deflector plates and so dimensioned that upon application of potential to said end deflector plates, equipotential surfaces are formed between said plates with an approximately spherical curvature around said central portion of said beam.

10. The electrostatic deflector defined in claim 9 wherein said end deflector plates are generally planar.

11. The electrostatic deflector defined in claim 9 wherein said end plates are mutually parallel.

12. The electrostatic deflector defined in claim 1 wherein each of said main deflector plates has a bulge in said dispersion plane.

13. The electrostatic deflector defined in claim 1 wherein said main deflector plates are generally of contours which are mirror symmetrical to said dispersion plane.

14. The electrostatic deflector defined in claim 1 wherein two main deflector plates are provided to generate a field approximating the field produced by four deflecting plates.

15. The electrostatic deflector defined in claim 1, further comprising an input aperture at said input side and an output aperture at said output side.

16. The electrostatic deflector defined in claim 15 wherein at least one of said apertures is curved.

17. The electrostatic deflector defined in claim 15 wherein said input aperture has an input slit and said output aperture has an output slit, at least one of said slits being curved.

* * * * *